US008525395B2

(12) United States Patent
Muessli

(10) Patent No.: US 8,525,395 B2
(45) Date of Patent: Sep. 3, 2013

(54) MULTI-COMPONENT LED LAMP

(75) Inventor: Daniel Muessli, Biel (CH)

(73) Assignee: Litetronics International, Inc., Alsip, IL (US)

( * ) Notice: Subject to any disclaimer, the term of this patent is extended or adjusted under 35 U.S.C. 154(b) by 0 days.

(21) Appl. No.: 13/022,013

(22) Filed: Feb. 7, 2011

(65) Prior Publication Data

US 2011/0193463 A1 Aug. 11, 2011

Related U.S. Application Data

(60) Provisional application No. 61/301,632, filed on Feb. 5, 2010, provisional application No. 61/334,163, filed on May 12, 2010.

(51) Int. Cl.
*H01J 1/02* (2006.01)

(52) U.S. Cl.
USPC ..... 313/46; 362/249.02; 362/294

(58) Field of Classification Search
USPC ..... 257/40, 72, 98–100, 642–643, 759, 257/79, 88, 706; 313/498–512, 45–47, 11–12, 313/33; 315/169.1, 169.3; 427/58, 64, 66, 427/532–535, 539; 428/690–691, 917; 438/26–29, 34, 82, 455; 445/24–25; 362/543–549, 555, 800, 249.01–249.03, 362/294, 235
See application file for complete search history.

(56) References Cited

U.S. PATENT DOCUMENTS

| | | | | |
|---|---|---|---|---|
| 7,226,189 | B2 * | 6/2007 | Lee et al. | 362/294 |
| 7,766,512 | B2 * | 8/2010 | Chou et al. | 362/294 |
| 7,892,000 | B1 | 2/2011 | Yen | |
| 7,993,032 | B2 * | 8/2011 | Budike | 362/294 |
| 2005/0111234 | A1 * | 5/2005 | Martin et al. | 362/555 |
| 2008/0291677 | A1 * | 11/2008 | Chen | 362/249 |
| 2009/0237932 | A1 * | 9/2009 | Lee | 362/249.02 |
| 2009/0237933 | A1 * | 9/2009 | Liu | 362/249.02 |
| 2010/0060130 | A1 | 3/2010 | Li | |
| 2010/0181885 | A1 | 7/2010 | Tessnow et al. | |
| 2010/0182788 | A1 | 7/2010 | Luo et al. | |
| 2011/0057557 | A1 * | 3/2011 | Chi et al. | 313/499 |
| 2011/0170287 | A1 * | 7/2011 | Medinis | 362/235 |

* cited by examiner

*Primary Examiner* — Donald Raleigh
(74) *Attorney, Agent, or Firm* — Steve Witters; Witters & Associates

(57) ABSTRACT

A multi-component LED lamp is disclosed herein. The multi-component LED lamp comprises an outer case housing with at least one heat sink and an array of LEDs disposed therein. The outer case comprises a plurality of vent openings and a light projecting end. The array of LEDs is disposed proximate the light projecting end in the outer case. Each heat sink disposed in the outer case is a separate component part of the LED lamp. The vent openings and heat sink(s) are disposed and configured to provide convective air flow pathways through the multi-component LED lamp and remove heat therefrom.

17 Claims, 9 Drawing Sheets

MULTI-COMPONENT LED LAMP

CROSS-REFERENCE TO RELATED APPLICATIONS

This application claims the benefit of U.S. Provisional Application No. 61/301,632, filed Feb. 5, 20010 and U.S. Provisional Application No. 61/334,163, filed May 12, 2010.

FIELD OF THE DISCLOSURE

This disclosure relates generally to lamps, and more particularly, to a multi-component light emitting diode (LED) lamp comprising an array of LEDs disposed therein and configured to dissipate heat generated by the array of LEDs.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Incandescent light bulbs have been and are currently used in a large variety of lighting products. An incandescent light bulb or lamp produces light by heating a metal filament wire to a high temperature until it glows. The hot filament is protected from air by a glass bulb that is filled with inert gas or evacuated. Most lamps are configured to be used in a socket and comprise a base, such as an Edison screw base, an MR16 shape with a bi-pin base, or a GU5.3 (Bipin cap) or GU10 (bayonet socket).

Even though incandescent light bulbs are relatively inexpensive, as compared to alternative light sources, incandescent light bulbs have several drawbacks. For example, incandescent light bulbs use a relatively large amount of power compared to other lighting products which increase energy costs. Also, incandescent light bulbs have a relatively short life causing repetitive replacement costs.

Recently, fluorescent lamps, particularly compact fluorescent lamps (CFLs), have been developed to overcome some of the drawbacks associated with the incandescent lamps. For example, fluorescent lamps are more efficient and have a longer life than incandescent lamps. A fluorescent lamp is a gas-discharge lamp that uses electricity to excite mercury vapor. The excited mercury atoms produce short-wave ultraviolet light that then causes a phosphor to fluoresce, producing visible light. Fluorescent lamps convert electrical power into useful light more efficiently than incandescent lamps, lowering energy costs. Larger fluorescent lamps are mostly used in commercial or institutional buildings and CFLs have been developed to be used in the similar manner as incandescent. Even though fluorescent lamps have overcome some of the drawbacks associated with the incandescent lamps, drawbacks remain. For example, fluorescent lamps contain mercury which is hazardous to human health and they may have a delayed response time when turning on the lamp.

More recently, light emitting diode (LED) lamps have been developed to overcome some of the drawbacks associated with the incandescent and fluorescent lamp. An LED lamp is a solid-state lamp that uses LEDs as the source of light. An LED may comprise a conventional semiconductor light emitting diode or an organic or polymeric light emitting diode. The light emitted by an LED is caused by the generation of photons from materials within the LED and is not the product of an electrical current passing through an illuminating filament. LED lamps may have one or more advantages over fluorescent lamps, for example, LED lamps do not contain mercury, they may turn on instantly, they may have a longer service life, they may have a smaller size, and they may have a greater efficiency.

However, currently available LED lamps may not be well suited for some lighting applications. For example, LED lamps may require a plurality of LEDs to provide a desired amount of light generation which may generate excessive heat. The heat generated from the LEDs may accumulate within the lamp and raise the operating temperature of the LEDs. Operating LEDs at a higher temperature may adversely affect the service life of the LED lamp. Currently available LED lamps may be insufficient for dissipating the generated heat. Additionally, currently available LED lamps may require complex heat management systems to dissipate heat generated by the LEDs. Such requirements may introduce obstacles in designing LED lamps having a desired service life.

What is needed is an LED lamp that overcomes some of the obstacles associated with currently available LED lamps and provides a desired service life.

SUMMARY

In one aspect of the present disclosure, a multi-component LED lamp comprises an outer case configured to house a first heat sink and an array of LEDs. The outer case comprises a plurality of vent openings and a light projecting end. An array of LEDs is disposed proximate the light projecting end of the outer case. A first heat sink is disposed in the outer case and is a separate component part of the LED lamp. The first heat sink comprises an outer peripheral portion disposed against an inner surface of the outer case, proximate the light projecting end of the outer case. The outer peripheral portion of the first heat sink is configured and disposed to provide conductive heat transfer between the outer case and the first heat sink. The first heat sink comprises an inner portion extending inwardly from the outer peripheral portion. The inner portion of the first heat sink comprises a plurality of vent openings in flow communication with the plurality of vent openings in the outer case and the light projecting end of the outer case. The inner portion of the first heat sink is configured and disposed to provide convective heat transfer to air flowing through the plurality of vent openings in the outer case and the light projecting end of the outer case.

In another aspect of the present disclosure, an LED lamp comprises an outer case with at least one vent opening and a light opening. A heat sink is disposed in conductive heat transfer communication with the outer case and comprises at least one vent opening therein, the heat sink is a separate component part of the LED lamp. The outer case and the heat sink are configured and disposed to provide convective heat transfer to air flowing between portions thereof.

In a further aspect of the present disclosure, a multi-component LED lamp comprises an outer case comprising a plurality of vent openings and is configured to dispose at least one heat sink and at least one LED. The multi-component LED lamp also comprises at least one heat sink disposed in the outer case configured to conduct heat away from the at least one LED and to convect heat to air flowing through the plurality of vent openings in the outer case.

BRIEF DESCRIPTIONS OF THE DRAWINGS

The following figures, which are idealized, are not to scale and are intended to be merely illustrative of aspects of the present disclosure and non-limiting. In the drawings, like elements are depicted by like reference numerals. The drawings are briefly described as follows.

DETAILED DESCRIPTION

Reference will now be made in detail to the present exemplary embodiments and aspects of the present invention, examples of which are illustrated in the accompanying figures. Wherever possible, the same reference numbers will be used throughout the figures to refer to the same or like parts.

Figure 1:
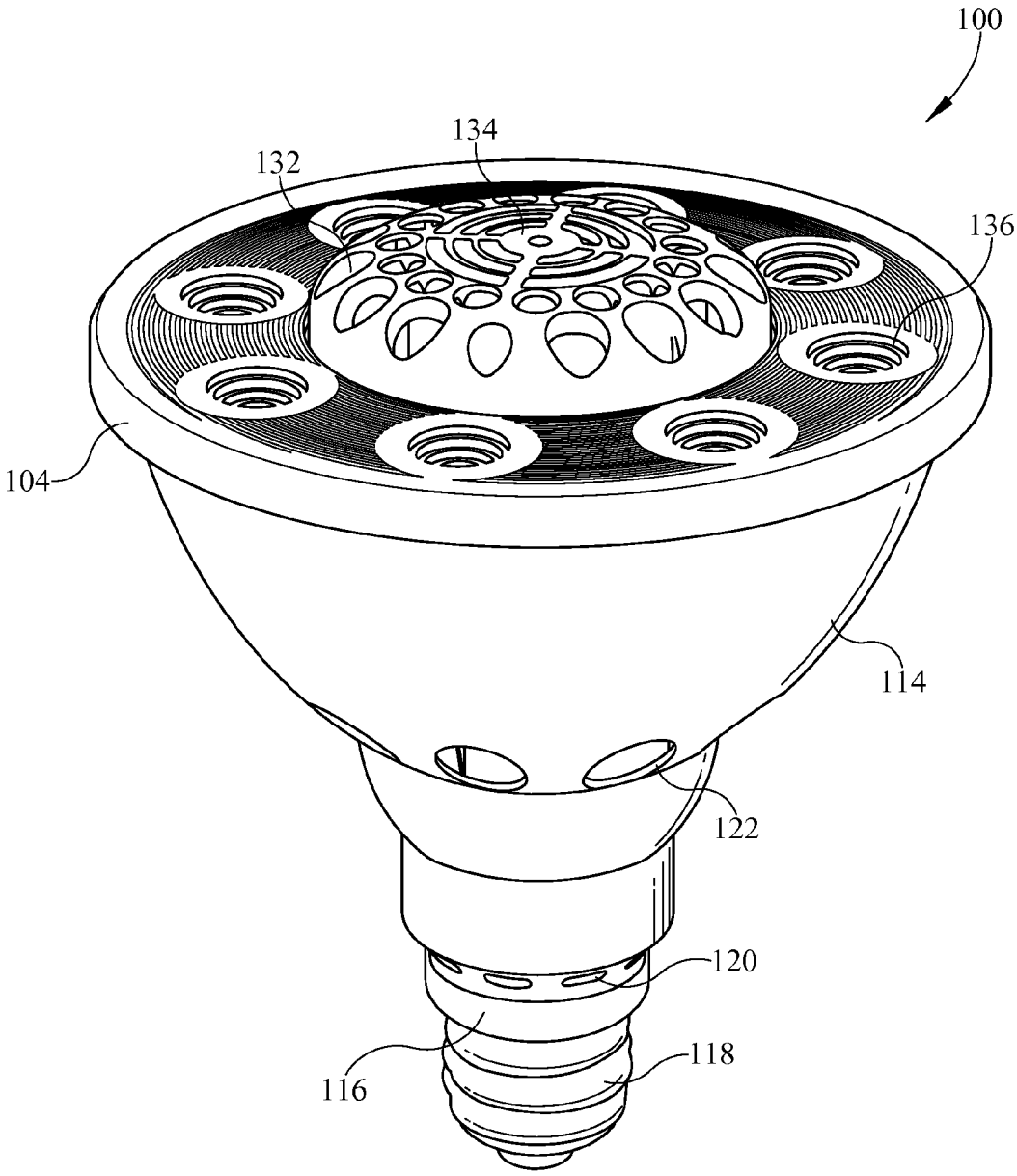
FIG. 1 is a perspective view of a multi-component LED lamp showing the disposition of vent openings therein.

FIG. 1 shows multi-component LED lamp 100 and the disposition of vent openings and other external components and features. Multi-component LED Lamp 100 is shown as comprising a connector 118 configured to connect LED lamp 100 to existing lamp sockets. Connector 118 may be an Edison screw base, as shown, a bi-pin base, a bayonet, or other connector configured to connect LED lamp 100 to a lamp socket. Alternatively, LED lamp 100 may be configured to connect any type of socket or may be a component part of a luminaire, hence not comprise a connector. Insulator 116 may be disposed between connector 118 and outer case 114. Advantageously, insulator 116 is comprised of an electrical insulating material and may also be a heat insulating material, for example a polymeric material. Insulator 116 may be configured and disposed to insulate outer case 114 from a flow of electricity through connector 118.

Outer case 114 extends from insulator 116 to an upper light projecting end. The terms upper and lower are used herein only to describe the disposition of components and features with relation to one another and the direction of natural convective air flow. The term lower means more proximate a natural convective air inlet while the term upper means more proximate a natural convective air outlet. Outer case 114 may comprise lower vent openings 120 in outer case 114 configured and disposed to allow cooling air to flow into and/or out of LED lamp 100. Outer case 114 may also comprise upper vent openings 122 configured and disposed to allow cooling air to flow into and/or out of LED lamp 100.

Lens 104 may be disposed about the light projecting end of outer case 114. Lens 104 may have a plurality of collimators 136 and may have other or additional light refracting contours. Lens 104 may be a ring shaped lens and vented cap 102 may be disposed within a central opening in lens 104. The outer portion 134 of vented cap 102 may extend outwardly from the light projecting end of outer case 114, as shown, be disposed substantially with a plane of lens 104, or may extend inwardly into the light projecting end of outer case 114. Outer portion 134 of vented cap 102 may comprise a plurality of vent openings 132 configured and disposed to allow cooling air to flow into and/or out of LED lamp 100.

Figure 2:
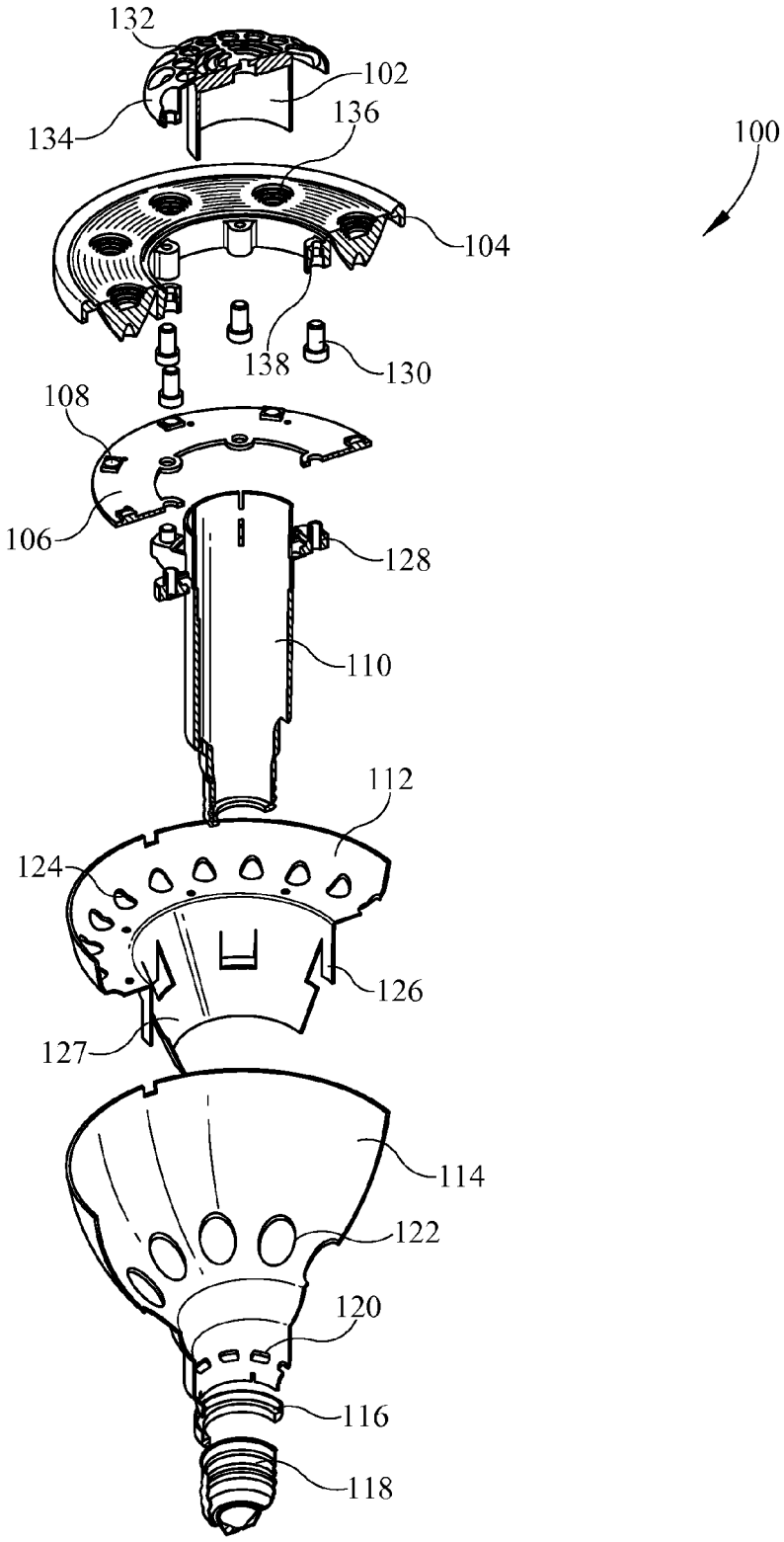
FIG. 2 is cross-sectional exploded view of the multi-component LED lamp of FIG. 1 showing component parts thereof.

FIG. 2 is an exploded view of multi-component LED lamp 100 showing separate component parts thereof. LED Lamp 100 may have insulator 116 configured to be disposed between connector 118 and outer case 114. Outer case 114 may be configured to extend from insulator 116 to an upper light projecting end thereof. Outer case 114 may comprise a plurality of vent openings 120 and 122. Outer case 114 may have a variety of configurations such as PAR38, PAR30, PAR20, BR30, or other configuration as is known in the art. Inner body 110 may be cylindrical and may be configured to support LED support 106 and other component parts within outer case 114. For example, inner body 110 may have a plurality of inner body connectors 128 configured to cooperate with connecting pins 130 and support LED support 106 and lens 104. LED support 106 may be configured to support a plurality of LEDs 108. LED support 106 may comprise a Metal Core Printed Circuit Board (MCPCB), a Chip on Board (COB), and/or other LED support devices or materials as are known in the art.

Lens 104 may be configured to be disposed about the light projecting end of outer case 114. Lens 104 may have a plurality of lens connectors 138 extending inward from an inner radius thereof, configured to cooperate with connecting pins 130 and inner body connectors 128. Vented cap 102 may be configured to be disposed within a central opening in lens 104. Vented cap 102 may have a cylindrical portion configured and disposed to be secured within inner body 110 and outer portion 134 may be configured to hide the cylindrical opening in inner body 110 and lens connectors 138, from sight.

Heat sink 112 may be a separate component part and may be configured to be disposed in an inner cavity of outer case 114. Heat sink 112 may comprise an outer peripheral portion configured to be disposed against the inner surface of outer case 114, proximate the light projecting end in outer case 114. Heat sink 112 may comprise an inner portion extending inwardly from the outer peripheral portion and may comprise a plurality of vent openings 124 configured to be disposed in flow communication with vent openings 122 in outer case 114 and the light projecting end in outer case 114, through vent openings 132. The inner portion of heat sink 112 may be configured to be disposed to provide convective heat transfer to air flowing through the plurality of vent openings 122 in outer case 114 and the light projecting end in outer case 114, through vent openings 132 in vented cap 102.

The outer peripheral portion of heat sink 112 may be configured to be disposed to support an array of LEDs 108 mounted on an LED support to allow convective air to flow between outer case 114 and LED support 106. An inner portion of heat sink 114 may comprise a frustoconical portion 127 extending inwardly from the outer peripheral portion and may be configured to dispose a larger diameter proximate the light projecting end in outer case 114. Frustoconical portion 127 may have a plurality of vent openings therein and each of these vent openings may have a tab 126 extending from an end thereof.

Figure 3:
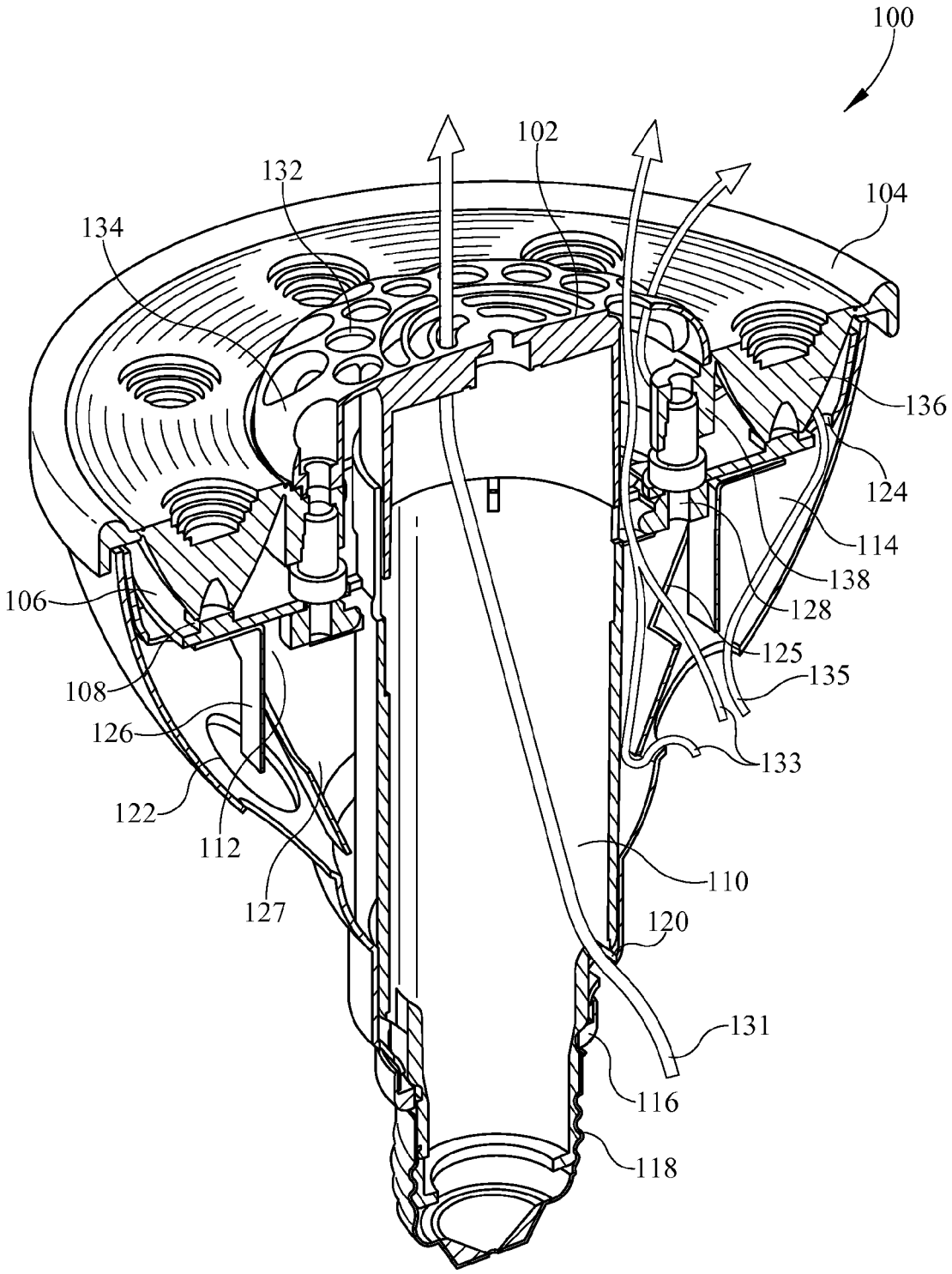
FIG. 3 is a cross-sectional view of the multi-component LED lamp of FIG. 1 showing the disposition of the component parts in an assembled lamp and convective air currents therethrough with the lamp disposed in a first orientation.
Figure 9:
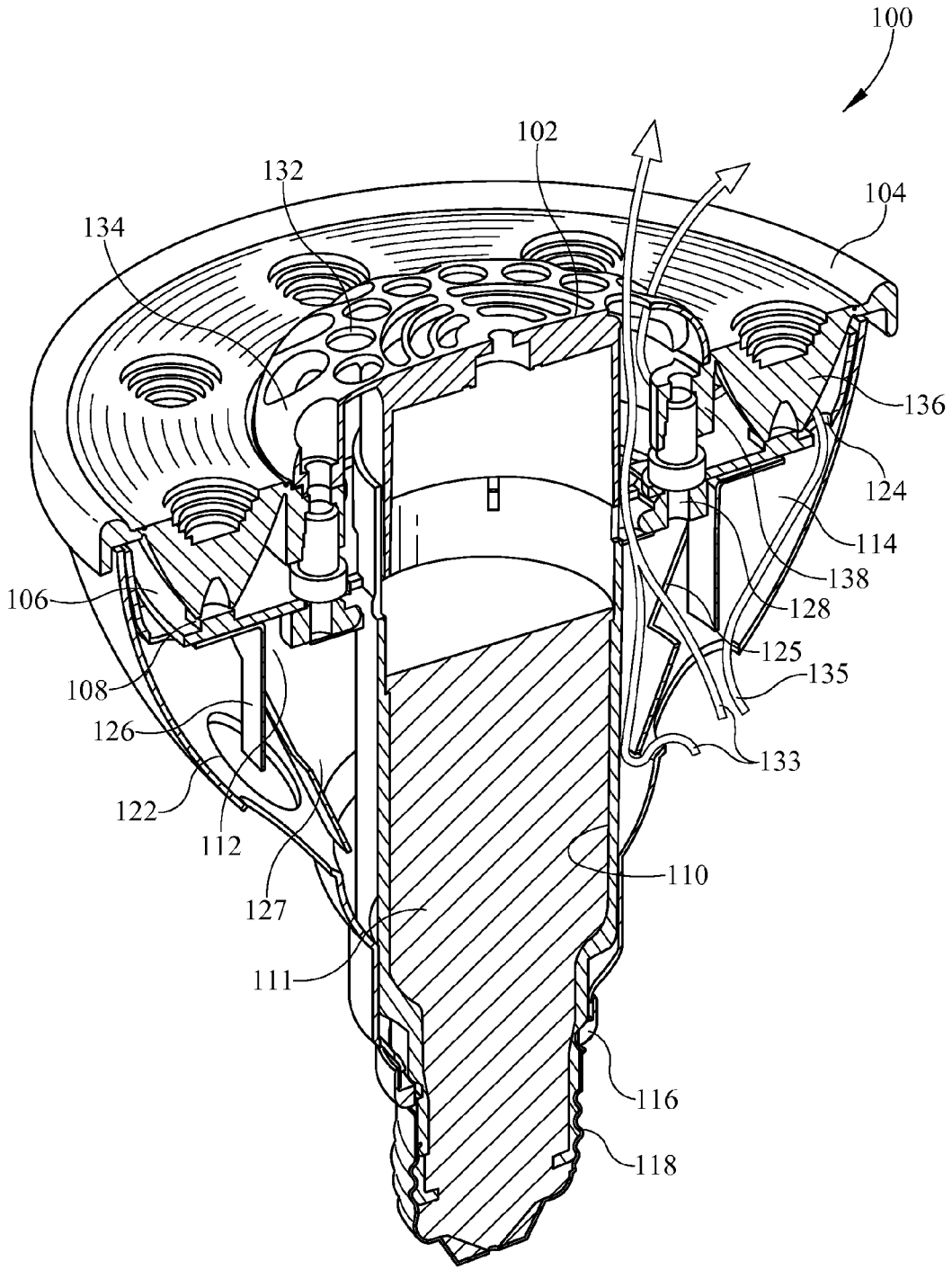
FIG. 9 is a cross-sectional view of a potted multi-component LED lamp.

FIG. 3 is a cross-sectional view of assembled multi-component LED lamp 100 showing the disposition of the component parts and convective air currents therethrough. LED Lamp 100 may have connector 118 disposed about a lower end of inner body 110. Insulator 116 may be disposed about inner body 110, between connector 118 and outer case 114. Outer case 114 may have a lower end extending into an upper portion of insulator 116 and about a lower portion of inner body 110. Outer case 114 may have vent openings 120 in flow communication with an inner portion of inner body 110. Vent openings 120 may be in flow communication with circuitry, not shown, disposed in connector 118 and/or inner body 110 wherein the circuitry may be configured to rectify AC power and convert voltage. It is to be understood that vent openings 120 may not be in inner body 110 and/or may be closed to air flow, as shown in FIG. 9 having inner body 110 potted.

Inner body 110 may extend upward and receive a cylindrical extending portion of vented cap 102. Vented cap 102 may have vent openings 132 disposed to be in flow communication with the inner portion of inner body 110 and air flowing outside of inner body 110. Outer case 114 may flare outwardly in a parabolic configuration to a light projecting end. Vent openings 122 may be disposed in the parabolic portion of outer case 114 and may be in flow communication with vent openings 132. Heat sink 112 may be a separate component part and may be disposed in an inner cavity of outer case 114. Heat sink 112 and outer case 114 may be separate component parts of LED lamp 100. Heat sink 112 may comprise an outer peripheral portion disposed against the inner surface of outer case 114, proximate the light projecting end in outer case 114. The outer peripheral portion of heat sink 112 may be configured and disposed to provide conductive heat transfer between outer case 114 and heat sink 112.

Heat sink 112 may comprise an inner portion extending inwardly from the outer peripheral portion and may comprise a plurality of vent openings 124 in flow communication with vent openings 122 in outer case 114 and the light projecting end in outer case 114 through vent openings 132. The inner portion of heat sink 112 may be configured and disposed to provide convective heat transfer to air flowing through the plurality of vent openings 122 in outer case 114 and the light projecting end in outer case 114, through vent openings 132 in vented cap 102.

Heat sink 112 may have a plurality of vent openings 124 disposed proximate outer case 114 and to be in flow communication with air flowing through outer case 114. The outer peripheral portion of heat sink 112 may support an array of LEDs 108 mounted on an LED support 106. LED support 106 may be disposed within vent openings 124, allowing convective air to flow between outer case 114 and LED support 106. LED support 106 may be comprised of a heat conductive material configured to conduct heat from LEDs 108 to heat sink 112. An inner portion of heat sink 112 may comprise a frustoconical portion 127 extending inwardly from the outer peripheral portion and have a larger diameter proximate the light projecting end in outer case 114. Frustoconical portion 127 may have a plurality of vent openings 125 therein and each of these vent openings may have a tab 126 extending from an end thereof.

Inner body 110 may have a plurality of inner body connectors 128 supporting LED support 106 and lens 104. LED support 106 may support an array of LEDs and may comprise one or more PCBs, MCPCBs, COBs, heat sinks, or other LED supports as are known in the art. Lens 104 may be disposed about the light projecting end of outer case 114 and may have a plurality of lens connectors 138 extending inward from an inner radius thereof, connecting with inner body connectors 128. Lens 104 may comprise an array of collimators 136, each disposed substantially equidistantly about lens 104 and substantially equidistantly from an outer periphery of LED lamp 100. Lens 104 may be comprised solely of a light transmissible material such as glass or polymeric materials. Lens 104 may comprise ridges or other light scattering pattern between each collimator 136 as shown or may have a smooth or other surface. Vented cap 102 may be disposed within a central opening in lens 104. Vented cap 102 may have a cylindrical portion secured within inner body 110 and outer portion 134 hiding the cylindrical opening in inner body 110 and lens connectors 138, from sight.

LED lamp 100 may be configured to provide natural convective air flow through and between component parts thereof. For example, orienting LED lamp 100 upward, as shown in FIG. 3, may cause heat transferred to inner body 110 to heat the air within inner body 110. Air heated within inner body 110 may rise and exit LED lamp 100 through vent openings 132. Air may then enter inner body 110 through vent openings 120, as indicated by convective air flow pathway 131. Heat transferred to heat sink 112 from LEDs 108 may heat air within the inner cavity of outer case 114 and exit LED lamp 100 through vent openings 132. Air may then enter LED lamp 100 through vent openings 122. Air may enter outer case 114 through vent openings 122, as indicated by convective air flow pathways 133 and 135. Air pathway 133 shows that convective air flow may enter vent openings 122 and flow into the inner portion 127 of heat sink 112 by flowing under inner portion 127 and/or through the vent openings 125 having tabs 126 extending from an end thereof. Air flowing into inner portion 127 may transfer heat from heat sink 112 and pass about LED support 106 and LEDs 108, transferring heat therefrom and out of LED lamp 100 through vent openings 132. Air flowing into vent openings 122 may also flow between the inner portion 127 of heat sink 112 and outer case 114 as indicated by air pathway 135. Air flowing between inner portion 127 and outer case 114 may transfer heat from heat sink 112 and outer case 114 and flow about LED support 106, through vent openings 124, about LEDs 108, and exit trough vent openings 132.

It is to be understood that multi-component LED lamp 100 may have a variety of configurations to provide an open volume or cavity therein and be configured to provide a variety of convective air flow pathways.

Figure 4:
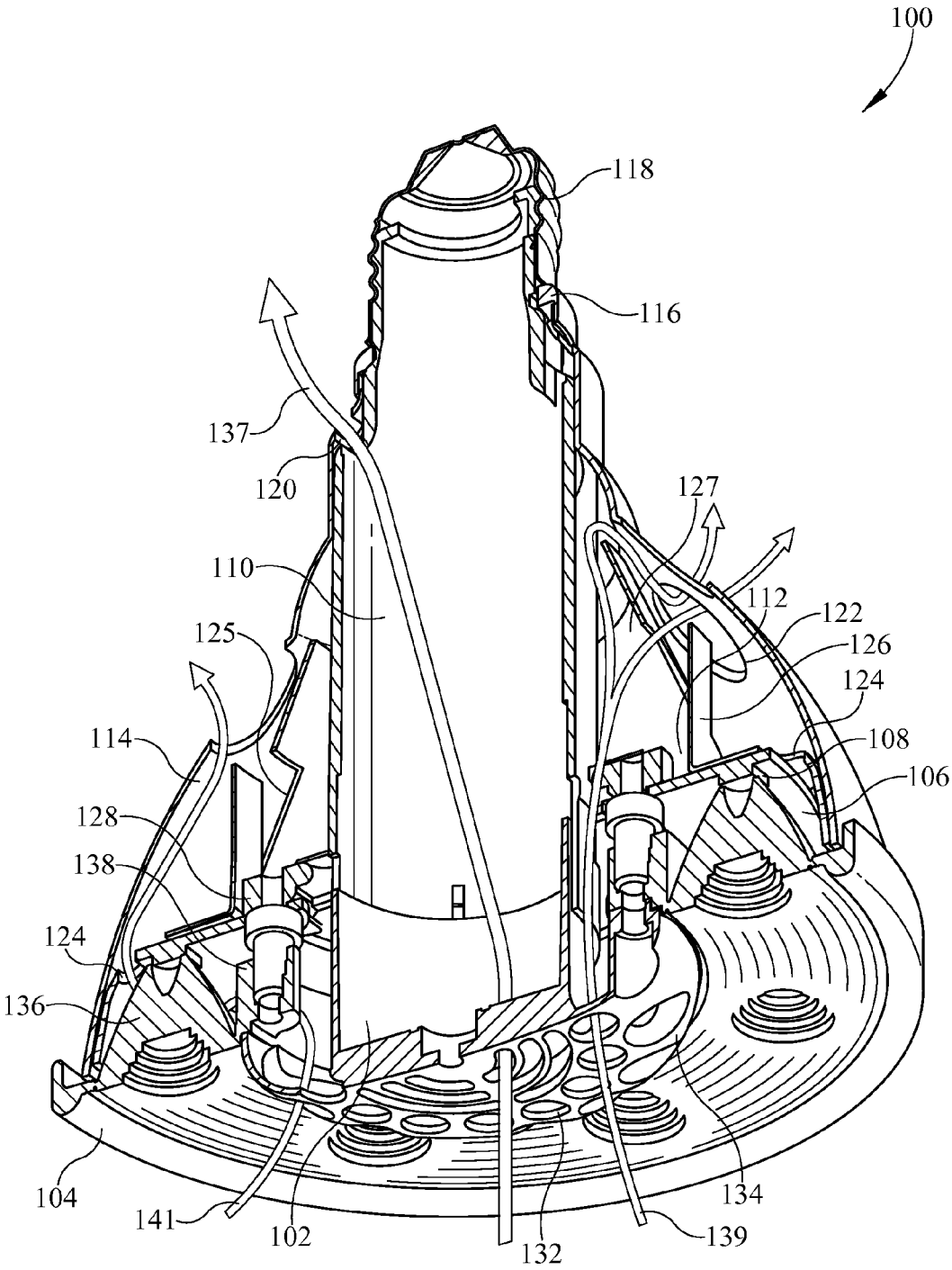
FIG. 4 is a cross-sectional view of the multi-component LED lamp of FIG. 1 showing convective air currents therethrough with the lamp disposed in a second orientation.

FIG. 4 shows LED lamp 100 in a downward orientation and natural convective air flow therethrough. In this orientation, air heated within inner body 110 may rise and exit LED lamp 100 through vent openings 120. Air may then enter inner body 110 through vent openings 132, as indicated by convective air flow pathways 137. Heat transferred to heat sink 112 may heat air within the inner cavity of outer case 114 and exit LED lamp 100 through vent openings 122, as indicated by air pathways 139 and 141. Air pathway 141 shows that air may enter LED lamp 100 through vent openings 132, pass about LED support 106 and LEDs 108, between outer case 114 and heat sink 112, through vent openings 124, and out through vent openings 122. Air pathway 139 shows that air may enter LED lamp 100 through vent openings 132, pass about LED support 106 and LEDs 108, between heat sink 112 and inner body 110, and out through vent openings 122. A portion of the air may flow around inner portion 127 and another portion of the air may flow along tabs 126. It is to be understood that air flowing into vent openings 132 and out vent openings 122 may mix within the inner open cavity of outer case 114, providing additional air flow pathways within LED lamp 100.

Figure 5:
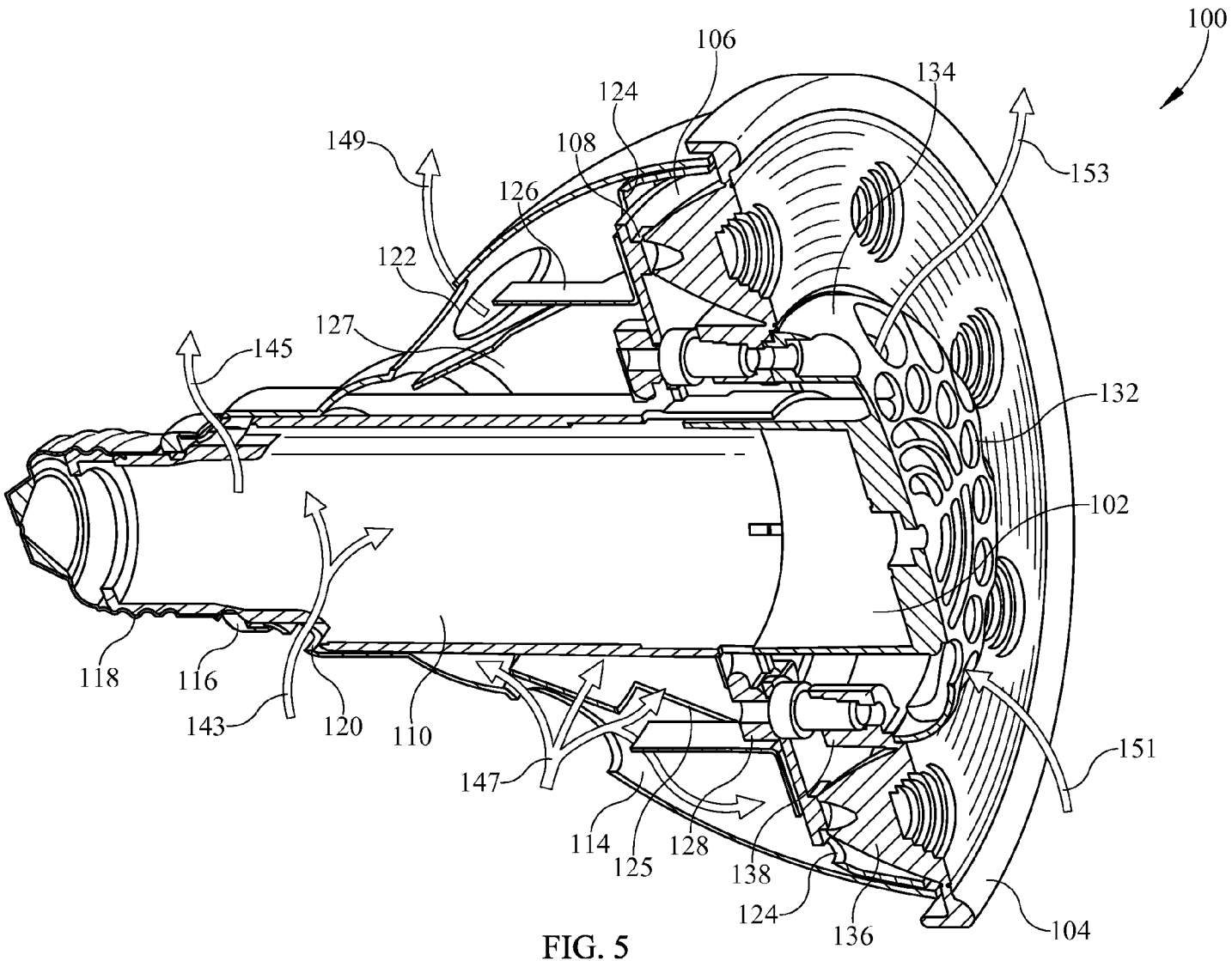
FIG. 5 is a cross-sectional view of the multi-component LED lamp of FIG. 1 showing convective air currents therethrough with the lamp disposed in a third orientation.

FIG. 5 shows LED lamp 100 in a horizontal orientation and natural convective air flow therethrough. In this orientation, air heated within inner body 110 may rise and exit LED lamp 100 through an upper portion of vent openings 120, 122, and 132. Air may then enter LED lamp 100 through a lower portion of vent openings 120, 122, and 132. For example, air may enter inner body 110 through a lower portion of vent openings 132 and a lower portion of vent openings 120, as indicated by air flow pathways 151 and 143. The air may then be heated with inner body 110 and flow out of LED lamp 100 through an upper portion of vent openings 132 and 120, as indicated with flow pathways 153 and 145. As indicated by convective air flow pathways 147 and, air may enter the inner open cavity of outer case 114 through a lower portion of vent openings 122 and 132 and exit LED lamp 100 through an upper portion of vent openings 122 and 132. Air flowing into LED lamp 100 along flow pathways 147 and 151 and out along flow pathways 149 and 153 may mix within the inner open cavity of outer case 114 and provide convective heat transfer from the component parts housed therein.

Figure 6:
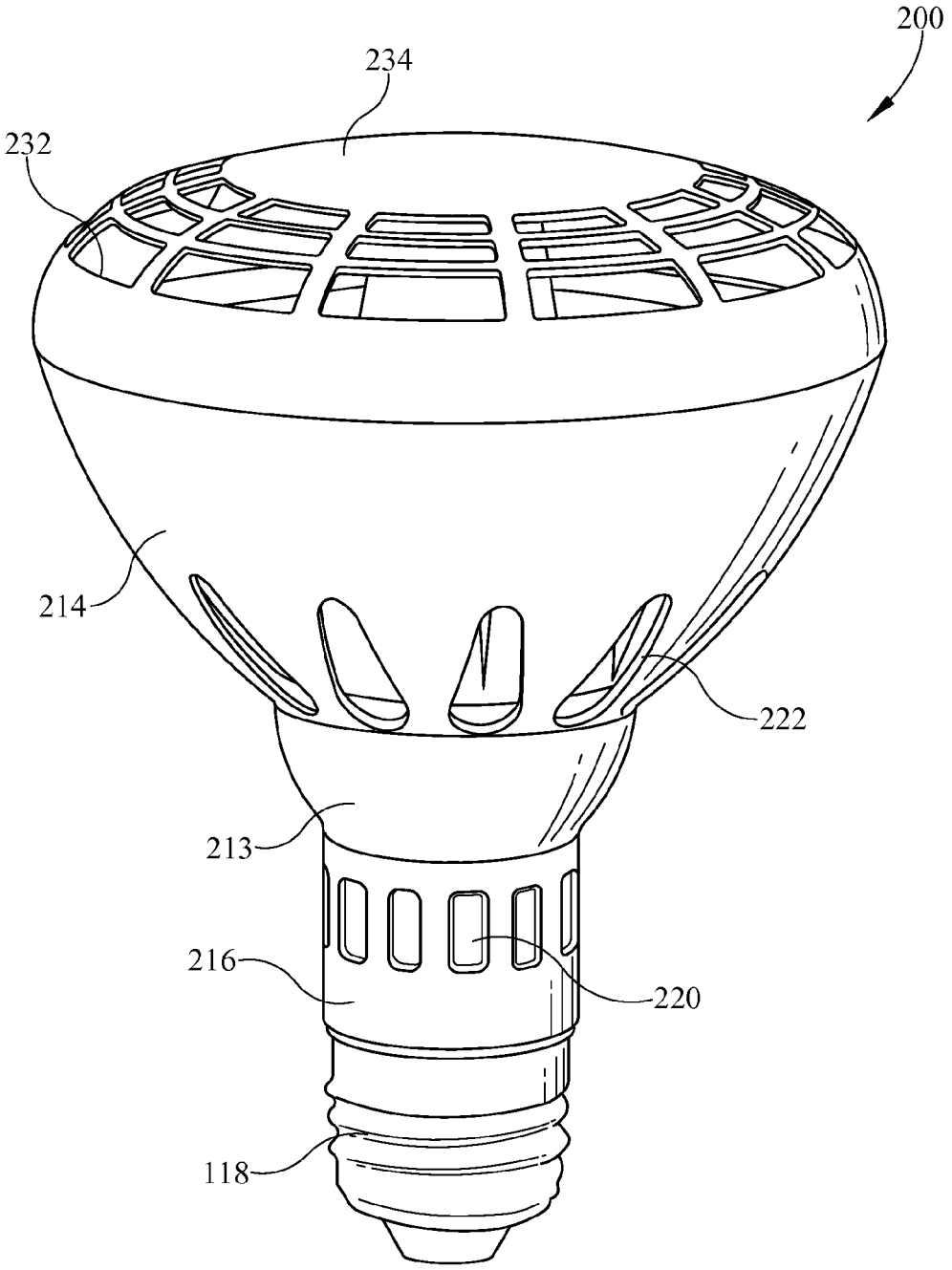
FIG. 6 is a perspective view of an alternative embodiment of the multi-component LED lamp showing the disposition of vent openings therein.

FIG. 6 is a perspective view of multi-component LED lamp 200 showing the disposition of vent openings and other external components and features. Multi-component LED lamp 200 is shown as comprising connector 118 adjacent driver heat sink 216. Driver heat sink 216 may be configured to house circuitry which may be configured to rectify AC power and convert voltage. Driver heat sink 216 may have vent openings 220 spaced there around. Thermal insulator 213 may mount with driver heat sink 216 and outer case 214. Outer case 214 may have a parabolic configuration and may extend from driver heat sink 216 to a light projecting end thereof. Vent openings 222 may be disposed about outer case 214 and configured to provide convective air flow through portions of LED lamp 200. Vented cap 234 may be disposed on the light projecting end of outer case 214 and may have a plurality of vent openings 232 therein. Vented cap 234 may have portions comprised of a translucent material configured to permit light emitted from LEDs 108 to project therethrough.

Figure 7:
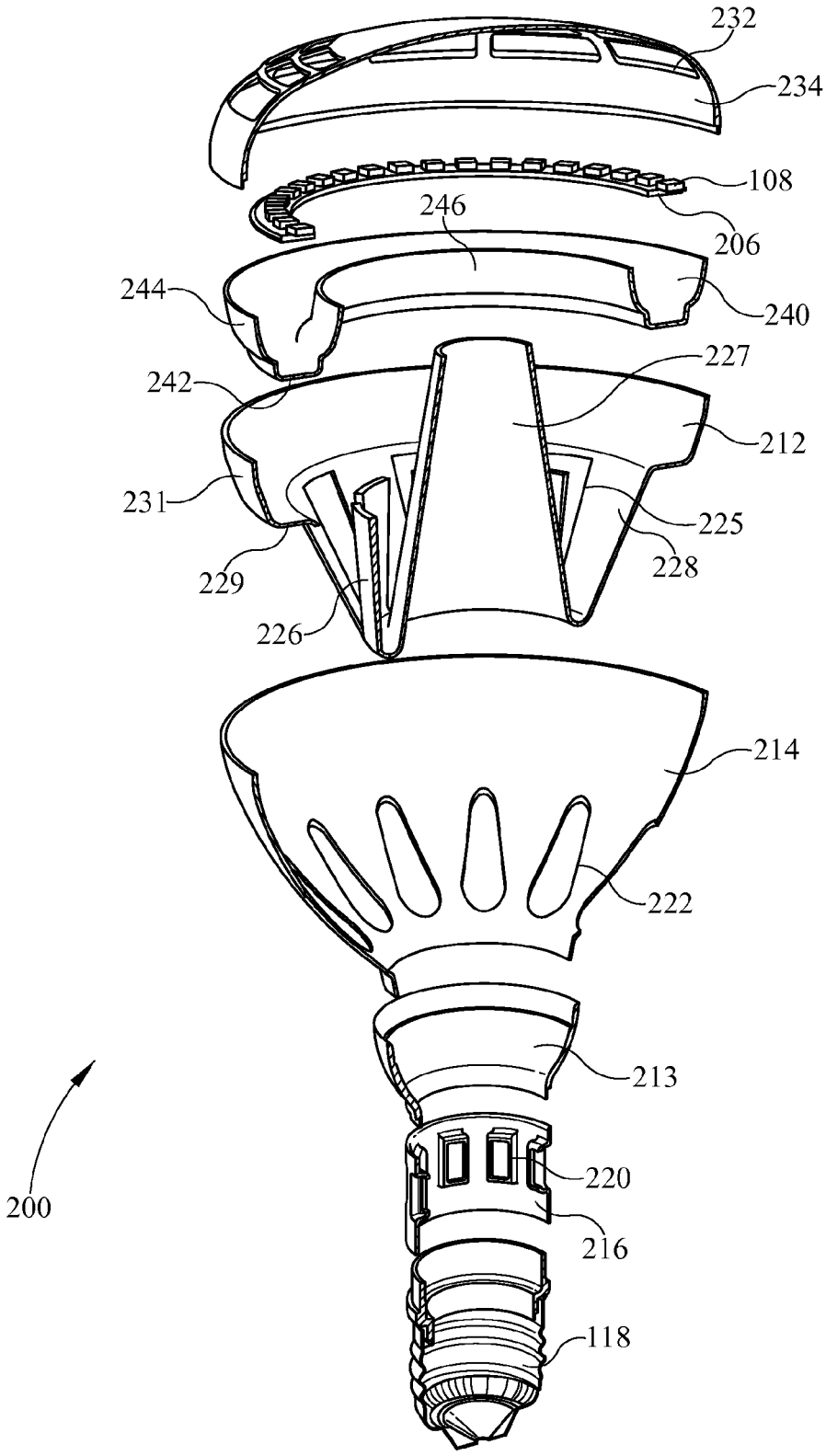
FIG. 7 is an exploded view of the multi-component LED lamp of FIG. 6 showing component parts thereof.

FIG. 7 is an exploded view of multi-component LED lamp 200 showing separate component parts thereof. LED Lamp 200 may have driver heat sink 216 configured to be disposed between connector 118 and thermal insulator 213. Driver heat sink 216 may be configured to house to house circuitry for driving LEDs 108. Driver heat sink 216 may have vent openings 220 disposed therein configured to cool the circuitry. Thermal insulator 213 may be configured to connect driver heat sink 216 to outer case 214 and prevent the conduction of heat therebetween.

Outer case 214 may be configured to be disposed to extend from thermal insulator 213 to an upper light projecting end. Outer case 214 may comprise a plurality of vent openings 222 configured and disposed to allow convective air to flow through LED lamp 200. Vented cap 234 may be configured to be disposed about the light projecting end of outer case 214. Vented cap 234 may be translucent and may comprise a plurality of vent openings 232 configured to be in flow communication with vent openings 220 and 222.

LED lamp 200 may be configured to dispose heat sink 212 within outer case 214. Heat sink 212 may be a separate component part of LED lamp 200. Heat sink 212 may comprise an outer peripheral portion 231 configured to be disposed against an inner surface of outer case 214, proximate its light projecting end. Outer peripheral portion 231 may be configured to be disposed to provide conductive heat transfer between outer case 214 and heat sink 212. Step portion 229 may extend inward from outer peripheral portion 231 and may be configured to dispose an array of LEDs 108. Heat sink 212 may comprise frustoconical portion 228 extending inwardly from outer peripheral portion 231 or stepped portion 229. Frustoconical portion 228 may extend toward connector 118 and may comprise a plurality of vent openings 225, configured and disposed to be in flow communication vent openings 220, 222, and 232. Frustoconical portion 228 may be configured to be disposed to provide convective heat transfer to air flowing through vent openings 220, 222, 225, and 232. Frustoconical portion 228 may have a larger diameter configured to be disposed proximate the light projecting end in outer case 214. Frustoconical portion 228 may comprise a plurality of vent openings 225 therein. Each vent opening 225 may have a tab 226 extending from an end thereof, disposed and configured to provide convective heat transfer to air flowing through outer case 214. Frustoconical portion 228 may have frustoconical portion 227 extending from the terminal end thereof. Frustoconical portion 227 may extend toward the light opening end of outer case 214. Frustoconical portion 227 may comprise a vent opening central with the array of LEDs 108 and may be configured to extend beyond the array of LEDs 108.

LED lamp 200 may be configured to dispose heat sink 240 about the array of LEDS 108. Heat sink 240 and may be configured to conduct heat generated with by LEDs 108 and transfer the conducted heat to air flowing through vent openings 220, 222, 225, and 232. Heat sink 240 may have an outer peripheral wall 244 and an inner peripheral wall 246 extending from a radially extending wall 242. The inner surfaces of outer peripheral wall 244 and inner peripheral wall 246 may be reflective and disposed to reflect light emitted by LEDs 108 out of the light projecting end of outer case 214. Outer peripheral wall 244 may be configured to be disposed to conduct heat to outer case 214 and/or heat sink 212. Heat sink 240 may be configured to dispose LED support 206 on radially extending wall 242. LED support 206 may be configured to support a plurality of LEDs 108 and may comprise a Metal Core Printed Circuit Board (MCPCB), a Chip on Board (COB), and/or other LED support devices or materials as are known in the art. Advantageously, LED support comprises a heat conductive material and is configured to conduct heat generated by LEDs 108 to heat sink 240.

Figure 8:
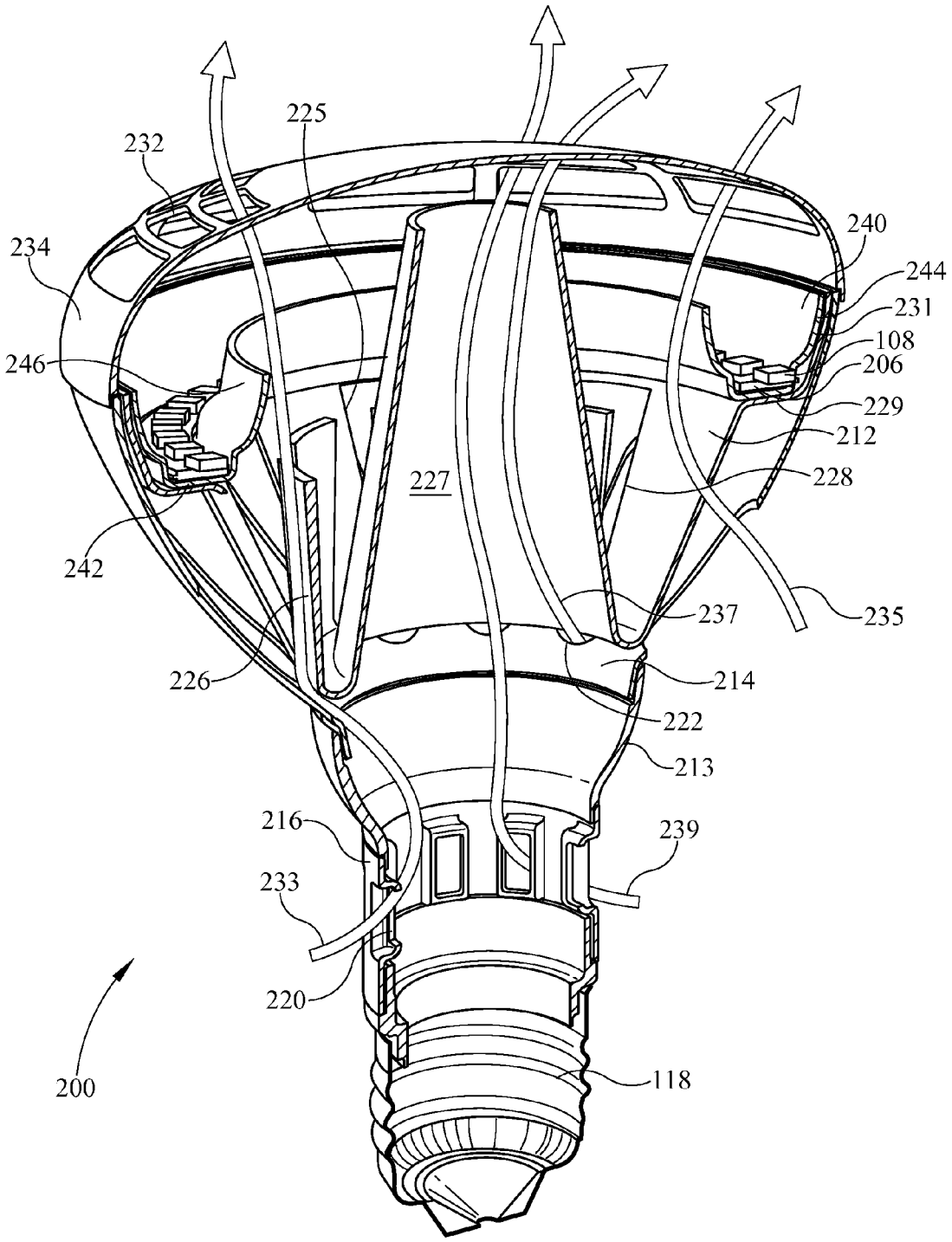
FIG. 8 is a cross-sectional view of the multi-component LED lamp of FIG. 6 showing the disposition of the component parts in an assembled lamp and convective air currents therethrough with the lamp disposed in a first orientation.

FIG. 8 shows the disposition of the component parts in assembled lamp 200 and convective air currents therethrough. LED Lamp 200 may have driver heat sink 216 disposed between connector 118 and thermal insulator 213. Driver heat sink 216 may be configured to house to house circuitry for driving LEDs 108. Driver heat sink 216 may have vent openings 220 disposed therein to cool circuitry. Thermal insulator 213 may be configured and disposed to connect driver heat sink 216 to outer case 214. Outer case 214 may be configured and disposed to extend from thermal insulator 213 to an upper light projecting end. Outer case 214 may comprise a plurality of vent openings 222 configured and disposed to allow convective air flow through LED lamp 200. Vented cap 234 may be configured and disposed about the light projecting end of outer case 214. Vented cap 234 may comprise a plurality of vent openings 232 configured to be in flow communication with vent openings 220 and 222.

Heat sink 212 may be disposed within outer case 214 and may be a separate component part of LED lamp 200. Heat sink 212 may comprise an outer peripheral portion 231 disposed against an inner surface of outer case 214, proximate its light projecting end, and may be configured and disposed to provide conductive heat transfer to outer case 214. Step portion 229 may extend inward from outer peripheral portion 231 and may be configured to dispose LEDs 108. Heat sink 212 may comprise frustoconical portion 228 extending inwardly from outer peripheral portion 231 or stepped portion 229. Frustoconical portion 228 may extend toward connector 118 and may comprise a plurality of vent openings 225, configured and disposed to be in flow communication vent openings 220, 222, and 232. Frustoconical portion 228 may be configured and disposed to provide convective heat transfer to air flowing through vent openings 220, 222, 225, and 232. Frustoconical portion 228 may comprise a plurality of vent openings 225 therein, wherein each vent opening 225 may have a tab 226 extending from an end thereof. Each tab 226 may be configured and disposed to provide convective heat transfer to air flowing through outer case 214. Frustoconical portion 228 may have frustoconical portion 227 extending from the terminal end thereof. Frustoconical portion 227 may extend toward the light opening end of outer case 214. Frustoconical portion 227 may comprise a vent opening central with LEDs 108 and may be configured to extend beyond LEDs 108.

Heat sink 240 may be disposed about LEDS 108. Heat sink 240 and may be configured to conduct heat generated with by LEDs 108 and transfer the conducted heat to air flowing through vent openings 220, 222, 225, and 232. Heat sink 240 may have an outer peripheral wall 244 and an inner peripheral wall 246 extending from a radially extending wall 242. Outer peripheral wall 244 may be configured and disposed to conduct heat to outer case 214 and/or heat sink 212. Heat sink 240 may be configured to dispose LED support 206 on radially extending wall 242. LED support 206 may be disposed to support a plurality of LEDs 108 and comprise a heat conductive material.

LED lamp 200 has a substantially open cavity within outer case 214. Individual component heat sinks 212 and 240 are disposed within the cavity in outer case 214, each configured to transfer heat from LEDs 108 to convective air flowing through lamp 200. The direction of natural convective air flow pathways through LED lamp 200 are dependent on the orientation in which LED lamp is positioned.

Examples of natural convective air flow pathways through LED lamp 200 are shown in FIG. 8 wherein LED lamp 200 is oriented with a light projecting end pointed up. Natural convective air flow pathway 233 shows that air may enter air vents 220, pass through driver heat sink 216 and thermal insulator 213 and enter outer case 214. The convective air may then flow about tabs 226 and frustoconical portion 227 of heat sink 212 and inner peripheral wall 246 of heat sink 240. The air may then exit heat from LED lamp 200 through vent openings 232. Natural convective air flow pathway 239 shows that air may enter vents 220, pass through driver heat sink 216 and thermal insulator 213 and enter outer case 214. The convective air may then flow through frustoconical portion 227 of heat sink 212 and remove heat from LED lamp 200 through vent openings 232. Natural convective air flow pathway 237 shows that air may enter air vents 222 and flow through frustoconical portion 227 of heat sink 212 and remove heat from LED lamp 200 through vent openings 232. Natural convective air flow pathway 235 shows that air may enter air vents 222 and flow about tabs 226 and frustoconical portion 227 of heat sink 212 and inner peripheral wall 246 of heat sink 240 and remove heat from LED lamp 200 through vent openings 232. It is to be understood that there may be a multitude of natural convective air flow pathways about component parts of LED lamp 200.

FIG. 9 shows that the multi-component lamp of the present disclosure may be potted. Potting compound III may be introduced into inner body 110 wherein it may fill a substantial portion of inner body 110 and connector 118. Potting compound III may comprise a polymeric material, such as a thermosetting compound, and/or other potting compounds as are known in the art. Potting compound III may be configured and disposed to evenly distribute the heat therein and communicate it to the outer surface of the inner body 110. Additionally, potting compound III may be disposed to encase circuitry in connector 118 and/or inner body 110 and be configured to provide resistance to shock and vibration, and the exclusion of moisture and corrosive agents. In this aspect of the multi-component lamp, there may be minimal or no air flow through inner body 110 and there may be no vent openings in a lower portion of inner body 110, as shown in FIG. 9.

Aspects of the present disclosure provide LED lamps that may be retrofitted into existing luminaires. Other aspects of the present disclosure may also provide complete LED fixtures, fixture modules, luminaires, illuminates, or other lighting apparatuses. For example, aspects of the present disclosure may comprise non replaceable LED lamp(s) permanently mounted in a luminaire or other lighting apparatus. In this aspect, the LED lamp(s) may comprise a standard connector or industry standard base configuration or the LED lamp(s) may be a non removable part of the lighting apparatus and may not comprise an industry standard base configuration.

Some examples of LEDs that may possibly be utilized or adapted for use in at least one possible embodiment may possibly be found in the following: U.S. Pat. No. 5,739,552, entitled "Semiconductor light emitting diode producing visible light"; U.S. Pat. No. 5,923,052, entitled "Light emitting diode"; U.S. Pat. No. 6,045,930, entitled "Materials for multicolor light emitting diodes"; U.S. Pat. No. 6,329,085, entitled "Red-emitting organic light emitting devices (OLED's)"; U.S. Pat. No. 6,869,813, entitled "Chip-type LED and process of manufacturing the same"; U.S. Pat. No. 6,967,117, entitled "Method for producing high brightness LED"; U.S. Pat. No. 7,229,571, entitled "Phosphor for white LED and a white LED"; U.S. Pat. No. 7,285,802, entitled "Illumination assembly and method of making same"; U.S. Pat. No. 7,402,831, entitled "Adapting short-wavelength LED's for polychromatic, broadband, or "white" emission"; and U.S. Pat. No. 7,838,317, entitled "Vertical nitride semiconductor light emitting diode and method of manufacturing the same".

Some examples of LED supports that may possibly be utilized or adapted for use in at least one possible embodiment may possibly be found in the following: U.S. Pat. No. 7,674,987, entitled "Multilayer printed circuit board"; U.S. Pat. No. 6,903,938, entitled "Printed circuit board"; U.S. Pat. No. 5,466,174, entitled "Apparatus to connect LEDs at display panel to circuit board"; U.S. Pat. No. 7,432,450, entitled "Printed circuit board", and U.S. Pat. No. 6,317,330, entitled "Printed circuit board assembly".

Some examples of collimators that may possibly be utilized or adapted for use in at least one possible embodiment may possibly be found in the following: U.S. Pat. No. 6,547,423, entitled "LED collimation optics with improved performance and reduced size"; U.S. Pat. No. 6,654,175, entitled "Integrated LED/photodiode collimator array"; U.S. Pat. No. 6,927,919, entitled "Collimating lens, collimating system, and image displaying apparatus using collimating system"; U.S. Pat. No. 7,370,994, entitled "Collimating lens for LED lamp"; U.S. Pat. No. 7,526,162, entitled "Collimator"; U.S.

Pat. No. 7,580,192, entitled "Collimation lens system for LED"; and U.S. Pat. Pub. No. 20070159847, entitled "Collimating lens for LED lamp".

Some examples of circuitry that may possibly be utilized or adapted for use in at least one possible embodiment may possibly be found in the following: U.S. Pat. No. 6,227,679, entitled "Led light bulb"; U.S. Pat. Pub. No. 20090289267, entitled "Solid state led bridge rectifier light engine"; U.S. Pat. No. 7,679,292, entitled "LED lights with matched AC voltage using rectified circuitry"; U.S. Pat. No. 6,359,392, entitled "High efficiency LED driver"; U.S. Pat. Pub. No. 20100084990, entitled "Dimmable LED lamp"; U.S. Pat. Pub. No. 20070069663, entitled "Solid state LED bridge rectifier light engine"; and U.S. Pat. No. 6,570,505, entitled "LED lamp with a fault-indicating impedance-changing circuit".

The patents, patent applications, and patent publication listed above in the preceding 4 paragraphs are herein incorporated by reference as if set forth in their entirety. The purpose of incorporating U.S. patents is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The invention is illustrated by example in the drawing figures, and throughout the written description. It should be understood that numerous variations are possible while adhering to the inventive concept. Such variations are contemplated as being a part of the present disclosure.

AT LEAST A PARTIAL LIST OF NOMENCLATURE

100 Multi-Component LED Lamp
102 Vented Cap
104 Lens
106 LED Support
108 LED
110 Inner Body
111 Potting Compound
112 Heat Sink
114 Outer Case
116 Insulator
118 Connector
120 Vent Openings in Outer Case
122 Vent Openings in Outer Case
124 Vent Opening in Heat Sink
125 Vent Openings
126 Tab
127 Inner Portion of Heat Sink
128 Inner Body Connector
130 Connecting Pin
131 Convective Air Flow Pathway
132 Vent Opening in Vented Cap
133 Convective Air Flow Pathway
134 Outer Portion of Vented Cap
135 Convective Air Flow Pathway
136 Collimator
138 Lens Connector
200 Multi-Component LED Lamp
206 LED Support
212 Heat Sink
213 Thermal Insulator
214 Outer Case
216 Driver Heat Sink
220 Vent Openings
222 Vent Openings
225 Vent Openings
226 Tab
227 Frustoconical Portion of Heat Sink
228 Frustoconical Portion of Heat Sink
229 Step Portion of Heat Sink
231 Outer Peripheral Portion of Heat Sink
232 Vent Openings
233 Convective Air Flow Pathway
234 Vented Cap
235 Convective Air Flow Pathway
237 Convective Air Flow Pathway
239 Convective Air Flow Pathway
240 Heat Sink
242 Radially Extending Wall of Heat Sink 240
244 Outer Peripheral Wall of Heat Sink 240
246 Inner Peripheral Wall of Heat Sink 240

The invention claimed is:

1. A multi-component LED lamp comprising:
an outer case configured to house a first heat sink and an array of LEDs;
said outer case comprising a plurality of vent openings and terminating with a light projecting end;
an array of LEDs disposed proximate said light projecting end of said outer case;
a first heat sink disposed in said outer case;
said first heat sink and said outer case being separate component parts of said LED lamp;
said first heat sink comprising an outer peripheral portion disposed in continuous contact with an entire inner perimeter of said outer case;
said outer peripheral portion of said first heat sink being configured and disposed to provide conductive heat transfer between said outer case and said first heat sink, continuously throughout said outer peripheral portion of said first heat sink and having a plurality of vent openings disposed proximate said outer case in flow communication with air flowing through said outer case;
said first heat sink comprising an inner first frustoconical portion extending inwardly from said outer peripheral portion and having a larger diameter proximate said light projecting end of said outer case; and
said inner portion of said first heat sink being configured and disposed to provide convective heat transfer to air flowing thereabout and through said plurality of vent openings in said outer case and said light projecting end of said outer case.

2. The LED lamp of claim 1 wherein said outer peripheral portion of said first heat sink supports said array of LEDs.

3. The LED lamp of claim 1 wherein said inner portion of said first heat sink comprises a second frustoconical portion extending from a terminal end of said first frustoconical portion and toward said light projecting end of said outer case, said second frustoconical portion comprising a central vent opening disposed central with said array of LEDs.

4. The LED lamp of claim 3 wherein said second frustoconical portion extends through said array of LEDs.

5. The LED lamp of claim 4 further comprising a second heat sink disposed about said array of LEDS and configured to conduct heat generated with said array of LEDs and transfer the conducted heat to air flowing through said plurality of vent openings in said first heat sink, said second heat sink being a separate component part of said LED lamp.

6. The LED lamp of claim 5 wherein said second heat sink comprises an outer peripheral surface configured and disposed to conduct heat to said outer case.

7. The LED lamp of claim 6 wherein said second heat sink is configured and disposed to reflect a portion of light emitted with said array of LEDs toward said light projecting end of said outer case.

8. The LED lamp of claim 7 wherein said array of LEDs are supported by a third heat sink, said third heat sink being one of a) and b):

a) Metal Core Printed Circuit Board; and b) Chip on Board.

9. The LED lamp of claim 1 wherein said array of LEDs has a plurality of LEDs substantially equidistantly spaced about an inner surface of said outer case.

10. An LED lamp comprising:

an outer case with at least one vent opening and terminating with a light opening;

a heat sink having an outer peripheral portion disposed in continuous contact with an entire inner perimeter of said outer case, proximate said light opening, and comprising a first frustoconical portion extending away from said light opening, said heat sink being a separate component part of said LED lamp;

an inner portion of said heat sink comprising a second frustoconical portion extending from a terminal end of said first frustoconical portion and toward said light opening; and said outer case and said heat sink being configured and disposed to provide convective heat transfer to air flowing between portions thereof.

11. The LED lamp of claim 10 wherein said first frustoconical portion of said heat sink has a plurality of vent openings therein.

12. The LED lamp of claim 10 wherein said outer peripheral portion of said first heat sink has a plurality of vent openings disposed proximate said outer case and in flow communication with air flowing through said outer case.

13. A multi-component LED lamp comprising:

an outer case comprising a plurality of vent openings and configured to dispose at least one heat sink and a plurality of LEDs;

at least one heat sink disposed in said outer case configured to conduct heat away from said plurality of LEDs and to convect heat to air flowing through said plurality of vent openings in said outer case; and said at least one heat sink comprising an outer peripheral portion in continuous contact with an entire inner perimeter of said outer case, a plurality of vent openings disposed proximate said outer case, and a central opening, and disposing said plurality of LEDs around said central opening.

14. The LED lamp of claim 13 wherein said at least one heat sink comprises a heat sink with a frustoconical portion extending inwardly from the outer peripheral portion thereof, said frustoconical portion having a larger diameter proximate a light projecting opening in said outer case.

15. The LED lamp of claim 14 wherein said frustoconical portion of said heat sink has a plurality of vent openings therein.

16. The LED lamp of claim 15 wherein each said plurality of vent openings in said frustoconical portion has a tab extending from an end thereof.

17. The LED lamp of claim 1 wherein said first frustoconical portion of said first heat sink has a plurality of vent openings therein.

* * * * *